US010125627B2

(12) United States Patent
Gieg et al.

(10) Patent No.: US 10,125,627 B2
(45) Date of Patent: Nov. 13, 2018

(54) METHOD FOR DISASSEMBLY AND ASSEMBLY OF A ROTOR OF A GAS TURBINE

(71) Applicant: MTU Aero Engines AG, Munich (DE)

(72) Inventors: Walter Gieg, Eichenau (DE); Petra Kufner, Poing (DE); Rudolf Stanka, Rattenkirchen (DE)

(73) Assignee: MTU Aero Engines AG, Munich (DE)

( * ) Notice: Subject to any disclaimer, the term of this patent is extended or adjusted under 35 U.S.C. 154(b) by 939 days.

(21) Appl. No.: 14/477,492

(22) Filed: Sep. 4, 2014

(65) Prior Publication Data

US 2015/0071769 A1 Mar. 12, 2015

(30) Foreign Application Priority Data

Sep. 6, 2013 (EP) ..... 13183274

(51) Int. Cl.
*F01D 11/00* (2006.01)
*F01D 11/08* (2006.01)
(Continued)

(52) U.S. Cl.
CPC ..... *F01D 11/08* (2013.01); *F01D 11/00* (2013.01); *F01D 11/12* (2013.01); *F01D 11/122* (2013.01); *F01D 25/24* (2013.01); *F01D 25/246* (2013.01); *F01D 25/285* (2013.01); *F01D 11/127* (2013.01); *F05D 2200/11* (2013.01);
(Continued)

(58) Field of Classification Search
CPC ..... F01D 11/08; F01D 25/24; F01D 11/122; F01D 11/00; F01D 11/12; F01D 25/246; F01D 25/285; F01D 11/127; F05D 2200/11; F05D 2230/60; F05D 2260/37; F05D 2220/3212; F05D 2260/36; F05D 2240/11; F05D 2230/70
See application file for complete search history.

(56) References Cited

U.S. PATENT DOCUMENTS 2,916,874 A * 12/1959 Worobel ..... F02C 7/20 415/126
5,267,397 A 12/1993 Wilcox
(Continued)

FOREIGN PATENT DOCUMENTS

| | | |
|---|---|---|
| DE | 601 22 083 T2 | 3/2007 |
| EP | 0 844 369 A1 | 5/1998 |
| FR | 2 891 583 A1 | 4/2007 |

OTHER PUBLICATIONS

European Search Report dated Mar. 21, 2014, with Statement of Relevancy (Eight (8) pages).

*Primary Examiner* — Richard Chang
(74) *Attorney, Agent, or Firm* — Crowell & Moring LLP

(57) ABSTRACT

A method for disassembly of a rotor, in particular the front rotor of a gas turbine with a housing and a channel which diverges in a direction of flow and in which the rotor is arranged, is disclosed. An embodiment of the method includes axially displacing an outer sealing ring that is radially opposite the rotor, and whose minimum inside diameter is smaller than the maximum outside diameter of the rotor, against the direction of flow. Then, the rotor is axially displaced against the direction of flow, in particular out of the housing. A method for assembly of such a rotor, as well as a tool for the same, is also disclosed.

7 Claims, 3 Drawing Sheets

(51) Int. Cl.
*F01D 11/12* (2006.01)
*F01D 25/24* (2006.01)
*F01D 25/28* (2006.01)

(52) U.S. Cl.
CPC .. *F05D 2220/3212* (2013.01); *F05D 2230/60* (2013.01); *F05D 2230/68* (2013.01); *F05D 2230/70* (2013.01); *F05D 2240/11* (2013.01); *F05D 2260/36* (2013.01); *F05D 2260/37* (2013.01)

(56) References Cited

U.S. PATENT DOCUMENTS 5,715,596 A * 2/1998 Bintz ..... F01D 5/10 29/888.02
6,200,091 B1 * 3/2001 Bromann ..... F01D 11/18 415/173.1
6,435,820 B1 * 8/2002 Overberg ..... F01D 25/246 415/1
6,575,697 B1 * 6/2003 Arilla ..... F01D 11/005 415/173.1
6,699,011 B2 * 3/2004 Cot ..... F01D 9/04 415/173.1
7,186,078 B2 3/2007 Tanaka
7,594,792 B2 * 9/2009 Audeon ..... F01D 11/005 277/630
7,594,795 B2 * 9/2009 Kriz ..... F01D 25/243 415/213.1
7,819,622 B2 * 10/2010 Paulino ..... F01D 9/041 415/104
7,836,596 B2 * 11/2010 Suciu ..... F01D 5/025 29/889.2
7,993,097 B2 * 8/2011 Amiot ..... F01D 9/04 415/116
8,038,393 B2 * 10/2011 Audeon ..... F01D 11/08 415/214.1
8,100,635 B2 * 1/2012 Dakowski ..... F01D 11/005 415/115
8,167,552 B2 * 5/2012 Antunes ..... F01D 11/24 415/139
8,192,149 B2 * 6/2012 Audeon ..... F01D 11/08 24/542
8,721,277 B2 * 5/2014 Gendraud ..... F01D 25/246 29/889.22
9,080,463 B2 * 7/2015 Denece ..... F01D 9/04
9,416,676 B2 * 8/2016 Gieg ..... F01D 11/122
9,518,472 B2 * 12/2016 Belmonte ..... F01D 9/042
2007/0231132 A1 10/2007 Durand et al.
2009/0081037 A1 * 3/2009 Audeon ..... F01D 11/08 415/209.3
2009/0123273 A1 * 5/2009 Audeon ..... F01D 11/08 415/177
2009/0123278 A1 * 5/2009 Audeon ..... F01D 11/08 415/214.1
2009/0123280 A1 * 5/2009 Audeon ..... F01D 11/08 415/214.1
2011/0243725 A1 10/2011 Jones et al.
2012/0027572 A1 * 2/2012 Denece ..... F01D 9/04 415/127

* cited by examiner

METHOD FOR DISASSEMBLY AND ASSEMBLY OF A ROTOR OF A GAS TURBINE

This application claims the priority of European Patent Application No. EP 13183274.3, filed Sep. 6, 2013, the disclosure of which is expressly incorporated by reference herein.

BACKGROUND AND SUMMARY OF THE INVENTION

The present invention relates to a method for disassembly of a rotor, in particular the first rotor of a gas turbine, a method for assembly of such a rotor as well as a tool for securing at least one additional rotor in such assembly or disassembly and a gas turbine particularly suitable for the same.

U.S. Pat. No. 7,186,078 B2, for example, discloses a low-pressure gas turbine having a housing and a channel, in which several rotors are arranged one after the other to withdraw energy from a gas.

The outside diameter of the channel and the rotors arranged in succession increase in the direction of flow.

According to in-house practice for assembly, the front rotor having the smallest outside diameter is first inserted into the conical channel from the rear against the direction of flow, then another rotor having a larger outside diameter, etc., until the most-rear rotor having the largest outside diameter is inserted. For disassembly of the front rotor, all the rear rotors must first be disassembled in the opposite order accordingly in a tedious operation before the front rotor can finally be pulled from the conical channel toward the rear.

On the other hand, the front rotor is usually exposed to the highest mechanical and/or thermal stresses, so that it must be disassembled most often for inspection purposes and/or maintenance purposes.

It is one object of an embodiment of the present invention to improve the inspection and/or maintenance of a gas turbine.

One aspect of the present invention relates to a method for disassembly of a rotor of a gas turbine. Another aspect relates to a gas turbine which is particularly suitable for this. Accordingly, the following explanations equally apply to a method and/or a gas turbine according to one aspect and/or advantageous embodiments of the present invention.

The gas turbine may be in particular a low-pressure gas turbine and/or turbine stage, preferably an aircraft engine, and may have a housing and a channel, in which the rotor is arranged and which diverges in a direction of flow. For a more compact presentation, in the present case a housing part of a multipart overall housing is also referred to simply as the housing.

A contour, in particular a diameter of the channel, may become wider in the direction of flow, in particular at least essentially monotonically and/or in increments.

The rotor to be disassembled is arranged in the channel and one or more additional rotors may be arranged in one embodiment. A guide baffle may be arranged upstream and/or downstream from one or more rotors, in particular between neighboring rotors, in the direction of flow.

In a refinement of the invention, the rotor to be disassembled is the first rotor, i.e., the most upstream rotor in the direction of flow and the additional rotors are the rear rotors, i.e., the more downstream rotors. Accordingly, in the present case, an axial upstream position in the direction of flow is understood to be the forward position and/or front position, while a downstream axial position in the direction of flow is understood to be the rear position, i.e., at the back.

In one embodiment, the rotor to be disassembled has a rotor disk plus one or more rotor blades distributed in the circumferential direction. The rotor blades may be attached detachably to the rotor disk, in particular in a form-fitting manner, preferably by means of profiled blade feet, or it may be attached permanently, in particular in a physically bonded manner, preferably designed to be integral with the rotor disk, i.e., as a so-called BLISK. In one embodiment, the rotor blades have outer casings on the outside radially, which together form an outer ring, while in another embodiment, the rotor blades are without an outer casing.

In one embodiment, the outside contour, in particular the outside diameter of the rotor blades of the rotor becomes larger, in particular that of an outside ring of the rotor in the direction of flow.

In one embodiment, the outer ring may have one or more radial flanges and/or sealing tips which are spaced a distance apart axially and extend radially outward. In one refinement, an outside diameter of a front radial flange is smaller than an outside diameter of a rear radial flange. In one embodiment, the maximum outside diameter of the rotor to be disassembled lies in its rear half in the direction of flow.

An outer sealing ring is arranged between the rotor and the housing. Accordingly, in one embodiment, the outer sealing ring of a gas turbine according to one aspect of the present invention is a first and/or most-forward and/or most-upstream outer sealing ring in the direction of flow.

The outer sealing ring may be detachably attached to the channel and/or housing. In particular a rear axial flange of the outer sealing ring in the direction of flow may be suspended in a corresponding groove in the housing, which, in one refinement, may be formed by a guide baffle attached to the housing. In one embodiment, the outer sealing ring has an abradable coating and/or a honeycomb seal on the inside radially and/or facing the rotor.

In one embodiment, an internal contour, in particular an inside diameter of the outer sealing ring, becomes wider in the direction of flow, in particular monotonically, preferably in one or more steps. In one refinement of the invention, a shoulder on the inside surface of the outer sealing ring to be installed is opposite a radial flange of an outer ring of the rotor to be dismantled, another shoulder being opposite another radial flange of the outer ring.

In one embodiment, a minimum inside diameter of the outer sealing ring, in particular toward the front, is smaller than the maximum outside diameter of the rotor, in particular as the most-rear outside diameter of an outer ring, preferably as the outside diameter of a radial flange (the farthest to the rear) of the outer ring.

According to one aspect of the present invention, the rotor to be disassembled is disassembled and/or displaced axially against the direction of flow, in particular being shifted out of the housing toward the front.

To do so, in one embodiment, first the outer sealing ring, whose (smaller) minimum inside diameter would come in conflict with the (larger) maximum outside diameter in the event of shifting of the rotor, is displaced axially against the direction of flow, in particular being shifted forward out of the housing. Next the rotor itself may also be displaced axially against the direction of flow, in particular being shifted forward out of the housing.

According to one aspect of the present invention, a rotor, in particular the front rotor, can be disassembled directly in this way, in particular without disassembly of rear rotors.

The inspection and/or maintenance, in particular replacement of the rotor can be simplified in this way.

If the maximum outside diameter of the outer sealing ring is smaller than the minimum (inside) diameter of the section of the channel situated in front of it in the direction of shifting, then the outer sealing ring may easily be displaced axially out of the channel against the direction of flow. However, if the minimum (inside) diameter of the section of the channel situated in front of it in the direction of shifting is smaller, this is not the case. Therefore, according to one aspect of the present invention, the outer sealing ring, whose maximum outside diameter is larger than a minimum (inside) diameter of the channel, is divided into two or more, preferably at least 16, in particular at least 32, parts in the circumferential direction. Then the outer sealing ring parts may be shifted radially inward and/or toward an axis of rotation of the gas turbine and may also be passed by the smaller inside diameter of the channel in this way.

This radial shift inward and the axial shift in the direction against the direction of flow may be superimposed at least partially and/or in some sections. In one embodiment, this can minimize the effort and/or movement space required for execution against the direction of flow. Additionally or alternatively, outer sealing ring parts may also be shifted strictly radially and/or strictly axially, at least in some sections and/or partially. For example, the outer sealing ring or outer sealing ring parts may first be shifted by an axial path length against the direction of flow, for example, up to blocking by the channel. Then the outer sealing ring parts may be shifted radially inward or with the superpositioning of another axial shift radially inward, so that they can pass by the channel.

In one embodiment, the outer sealing ring parts are also tilted in addition to their axial and/or radial shift, in particular to release them from a circumferential groove in the housing prior to being displaced axially. In a preferred embodiment, however, the outer sealing ring parts may be, at least essentially, axially tilt-free and may optionally be shifted radially and/or need not be tilted in advance for the axial shift. It is possible in particular to provide that the outer sealing ring and/or the outer sealing ring parts are displaced axially in a tilt-free manner at first.

In this regard, according to one aspect of the present invention in particular, the outer sealing ring is attached to the housing in a non-form-fitting manner with frictional locking, detachably and against the direction of flow. In the present case, this is understood in particular to mean that the outer sealing ring is attached to the housing in a releasable and frictionally locked manner, such that it can be displaced axially, in particular microscopically, and/or by at least 5 mm, after releasing the friction locking against the direction of flow without a radial shoulder of a friction contact surface of the housing opposing this friction-locking connection to the outer sealing ring, in particular a wall of a circumferential grove. The outer sealing ring may be attached to the housing detachably and in a friction-locking manner, by a one-piece or multipiece stretched so-called C ring ("C clip") in one embodiment.

In one refinement of the invention, however, the outer sealing ring may be secured on the housing in a form-fitting manner in the direction of flow, in particular by a one-sided shoulder, such that in the present case a circumferential groove is referred to as a two-sided shoulder in contrast with such a one-sided shoulder.

In one embodiment, the outer sealing ring is secured on the housing in a form-fitting manner in the circumferential direction. To do so, in another refinement, the outer sealing ring may have one or more radial protrusions, which extend radially outward from an outer circumferential surface of the outer sealing ring for friction locking with a radially opposed inner circumferential surface of the housing and may engage in corresponding axial grooves in the housing which may be arranged in particular on an end face of the housing that is at the front in the direction of flow. Additionally or alternatively, the housing may have one or more radial protrusions which extend radially inward from an inner circumferential surface of the housing for friction locking with a radially opposite outer circumferential surface of the outer sealing ring and may engage in corresponding axial grooves in the outer sealing ring, which may be arranged in particular on an end face of the outer sealing ring that is at the rear in the direction of flow. The extent of the radial protrusion in the circumferential direction may be smaller than, equal to, or larger than the distance in the circumferential direction between two walls that are adjacent in the circumferential direction of two grooves that are adjacent in the circumferential direction.

Accordingly, in one embodiment, the outer sealing ring and the housing may be attached to one another in a friction-locking manner and may be secured not in a friction-locking manner only in the circumferential direction and/or in the flow direction but not secured in the direction against the direction of flow, in particular not by means of a circumferential groove.

In one embodiment, an initial tilting of the outer sealing ring and/or outer sealing ring parts may be prevented in this way by the fact that these are initially displaced axially in a direction against the direction of flow. In this way, it is advantageously possible to reduce the sealing gap between the outer sealing ring and the rotor, which must otherwise be enlarged to permit tilting, but that would negatively impact the sealing effect.

Depending on the structural design, the rotor to be disassembled may oppose a radial shifting of the outer sealing ring parts in its assembly position. Therefore in particular in one embodiment of the present invention, the rotor is shifted first axially in the direction of flow and/or before the radial shifting of the outer sealing ring parts. In this way, in one embodiment, (additional) space for radial shifting of the outer sealing ring parts may be made available toward the inside radially, optionally with superpositioning of an axial shifting against the direction of flow. Likewise, however, it is also possible to provide for the outer sealing ring and/or the outer sealing ring parts to be initially displaced axially in a direction against the direction of flow without first displacing or having to displace the rotor in the direction of flow.

The housing may be connected at its front end face to a connecting flange. This connecting flange may in particular be part of a high-pressure turbine or the like, which is upstream from a low-pressure turbine, or may be part of a connecting piece thereto. Likewise, the connecting flange may also be part of a transport cover for closing the channel or the like.

Accordingly, in one embodiment of the present invention, a connecting flange which is connected to the housing and whose inside diameter facing the rotor is smaller than the maximum outside diameter of the outer sealing ring is released from the housing before the axial shifting of the outer sealing ring in the direction against the direction of flow. A connecting flange without a through-opening is also referred to as a connecting flange to this extent, its inside diameter facing the rotor being equal to zero and thus smaller than the maximum outside diameter of the outer sealing ring.

In one embodiment of the present invention, a connection of the outer sealing ring to the housing, in particular a C ring, in particular a friction-locking connection is released prior to the axial shifting of the outer sealing ring in the direction against the direction of flow.

In one embodiment, one or more additional rotors of the gas turbine may be supported radially and/or axially by means of the rotor to be disassembled. In disassembly of the rotor without prior disassembly of the additional rotors, this support and/or bearing is omitted. Accordingly, in one embodiment, one or more additional rotors of the gas turbine is/are secured otherwise prior to the axial shifting of the rotor to be disassembled in the direction against the direction of flow. To do so, they may in particular be secured by a releasable tool that is secured on at least one of the additional rotors detachably in particular in a friction-locking and/or form-fitting manner and is in turn supported. The tool may be supported on the housing of the gas turbine in particular, preferably in a friction-locking and/or form-fitting manner.

Accordingly, one aspect of the present invention relates to a tool for securing one or more additional rotors in assembly or disassembly of a rotor of a gas turbine according to one of the methods described here, in particular its use for securing one or more additional rotors in assembly or disassembly of a rotor of a gas turbine according to one of the methods described here. In one embodiment, the tool has fasteners for form-fitting and/or friction-locking attachment to the housing and/or to one or more additional rotors of the gas turbine. The fasteners may in particular have one or more recesses and/or protrusions for form-fitting attachment and/or one or more tension devices in particular screws for friction-locking attachment. In one embodiment, the tool has a radial flange for attachment to a housing and an axial web to reach through one or more additional rotors radially and be attached to them.

One aspect of the present invention relates to the initial assembly or re-assembly of the rotor, in particular the front rotor in the direction of flow in the front into the housing. This assembly may essentially take place in the opposite order from the disassembly mentioned first so that reference is made thereto in addition.

Accordingly, in one embodiment, first the rotor to be assembled is displaced axially in the direction of flow, in particular into the housing and then the outer sealing ring is displaced axially in the direction of flow, in particular into the housing.

In one embodiment, parts of the outer sealing ring are shifted radially toward the housing of the gas turbine and then joined together to form the outer sealing ring, in particular being clamped in the circumferential direction and/or connected in a form-fitting manner. This radial shifting may be superimposed on axial shifting of the entire outer sealing ring or the outer sealing ring parts at least in sections and/or in phases.

In one embodiment, the rotor is displaced axially against the direction of flow after the radial shifting of the outer sealing ring parts. Space for movement can occasionally be created for the radial shift in this way.

In one embodiment, after the axial shifting of the outer sealing ring in the direction of flow, a connecting flange whose inside diameter facing the rotor is smaller than the maximum outside diameter of the outer sealing ring is connected to the housing, preferably detachably. Additionally or alternatively, after the axial shifting of the outer sealing ring in the direction of flow, the outer sealing ring is attached to the housing, preferably detachably, and/or a connection of the outer sealing ring to the housing may be closed. A C ring in particular may be attached to clamp the outer sealing ring and the housing in a friction-locking manner.

As explained above, one or more additional rotors may be secured during assembly, in particular by a detachable tool. In particular after the rotor to be assembled has been assembled, in particular being supported and/or mounted on the housing, a corresponding attachment and/or the tool may be released.

Additional advantageous refinements of the present invention are derived from the dependent claims and the following description of preferred embodiments.

DETAILED DESCRIPTION OF THE DRAWINGS

Figure 1:
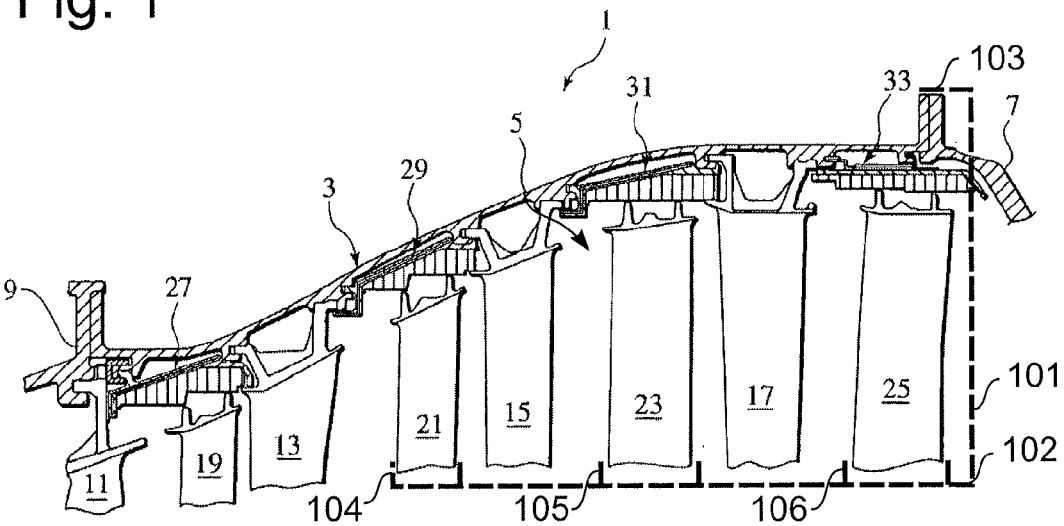
FIG. 1 shows one part of a gas turbine with a tool according to one embodiment of the present invention.

FIG. 1 shows a low-pressure gas turbine having a housing 3 and a channel 5, which diverges in the direction of flow (from left to right in FIG. 1), in that its diameter increases essentially monotonically in the direction of flow.

In the channel, a front rotor 19 in the direction of flow as well as several other rear rotors 21, 23 and 25 are arranged one after the other in the direction of flow.

Guide baffles 11, 13, 15 and 17 are arranged between and/or in front of the rotors and are attached to the housing.

The housing is detachably connected to a connecting flange 9 of a high-pressure turbine upstream from the low-pressure turbine 1 on its front end face (upper left in FIG. 1) and is connected to an outlet housing 7 on its rear end face (at the right in FIG. 1).

An outer sealing ring 27, 29, 31 and/or 33 is arranged between each rotor and the housing.

The rotor 19 to be disassembled has a plurality of rotor blades distributed in the circumferential direction, one of which is shown in part in FIG. 1, and a rotor disk (not shown) to which the rotor blades are attached.

Figure 2A:
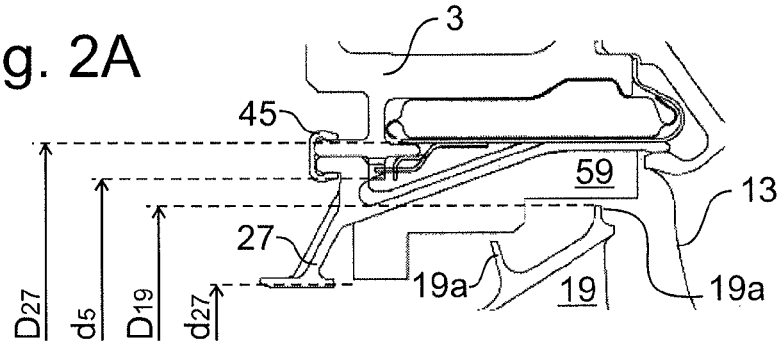
FIGS. 2A-2C show steps of a method for disassembly of a rotor of a gas turbine according to one embodiment of the present invention.
Figure 2B:
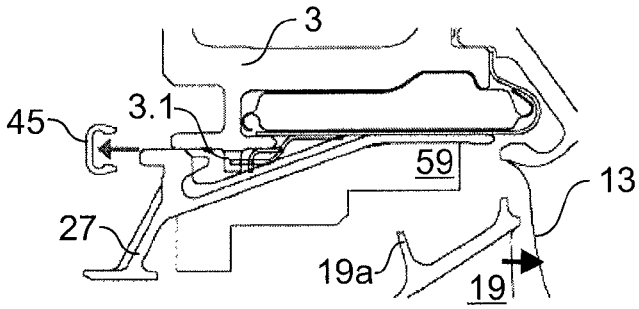
Figure 2C:
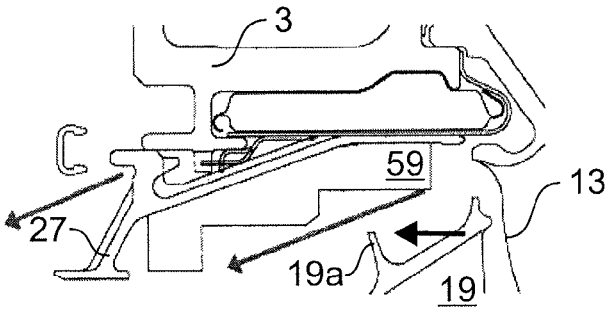

FIGS. 2A-C show steps in a method for disassembly of a rotor of a gas turbine of an aircraft engine according to one embodiment of the present invention on the basis of an enlarged partial diagram, corresponding essentially to FIG. 1, which is explained above, so that corresponding elements are labeled with identical reference numerals, and reference is made otherwise to the remaining description and only the differences are discussed.

The rotor blades have outer casings on the outside radially, together forming an outer ring. The outside diameter of this outer ring increases in the direction of flow. The outer ring has two radial flanges and/or sealing tips 19*a* spaced a distance apart axially (see FIG. 2A), which extend radially outward, the outside diameter of a front radial flange (at the left in FIG. 2A) being smaller than the outside diameter of a rear radial flange (at the right in FIG. 2A).

The outer sealing ring 27, which is arranged between the rotor 19 and the housing 3, is detachably attached to the channel and/or housing. To do so, a rear axial flange (at the right in FIG. 2A) of the outer sealing ring is suspended between the housing and a following guide baffle 13, and a front axial flange (at the left in FIG. 2A) of the outer sealing ring is attached to the housing by a C ring 45.

The outer sealing ring is attached to the housing against the direction of flow in a friction-locking and detachable manner without any form-fitting connection. It can be seen here, in particular on the basis of the sequence of figures described below, i.e., FIG. 2A→FIG. 2B, that the outer sealing ring is displaceable axially against the direction of flow (toward the left in FIG. 2A) after releasing the C ring, without thereby being hindered due to a stop on the friction contact area between the outer sealing ring and the housing.

The inside circumferential surface of the housing 3 for the friction-locking connection to the outer circumferential surface of the outer sealing ring 27, which is on the opposite end radially, has a plurality of radial protrusions 3.1 (see FIG. 2B), which extend radially inward and engage in axial grooves in a rear end face (at the right in FIG. 2) of the outer sealing ring in the direction of flow in order to affix this to the housing in the circumferential direction as well as in a form-fitting manner in the direction of flow.

The outer sealing ring has an abradable coating 59, formed as a honeycomb seal on the inside radially, i.e., facing the rotor.

The inside diameter of the outer sealing ring increases monotonically in multiple steps in the direction of flow, where one shoulder of the assembled outer sealing ring is opposite a radial flange (at the left in FIG. 2A) of the outer ring of the rotor to be disassembled, while another shoulder of the assembled outer sealing ring is opposite another radial flange (at the right in FIG. 2A) of the outer ring.

A minimum and most forward inside diameter $d_{27}$ of the outer sealing ring 27 is smaller than the maximum outside diameter $D_{19}$ of the rotor 19, in particular smaller than the outside diameter of its most rear radial flange 19*a*.

For disassembly of the most forward rotor 19 out of the housing 3 toward the front and against the direction of flow, the connecting flange 9 (see FIG. 1), which is connected to the housing 3 and whose inside diameter (at the right in FIG. 1) facing the rotor is smaller than the maximum outside diameter $D_{27}$ of the outer sealing ring (see FIG. 2A), is released from the housing 3.

Then the connection of the outer sealing ring 27 to the housing 3 in the form of the C ring 45 is released, as indicated by an arrow in FIG. 2B.

In advance, at the same time or subsequently, as also indicated by an arrow in FIG. 2B, the rotor 19 is displaced axially in the direction of flow to make space available for a radial shifting of the outer sealing ring parts toward the inside radially. In one modification that is not shown here, this step may also be omitted.

The maximum outside diameter $D_{27}$ of the outer sealing ring is larger than the minimum (inside) diameter $d_5$ of the section of the channel lying in front in the direction of shifting (from right to left), so the outer sealing ring cannot be shifted completely out of the channel axially against the direction of flow. Therefore, for disassembly of the outer sealing ring 27, first it is displaced axially against the direction of flow and then it is divided into two or more parts, which are then shifted radially inward and/or toward an axis of rotation of the gas turbine, and in this way it also passes by the smaller inside diameter of the channel, as indicated by arrows in FIG. 2C. This radial shift toward the inside is also superimposed on an additional axial shift of the outer sealing ring and/or its parts against the direction of flow, as also indicated by these arrows.

Next, the rotor 19 itself is displaced axially against the direction of flow toward the front out of the housing 3 and thus is disassembled directly without disassembly of the rear rotors 21, 23, and 25. The inspection and/or maintenance, in particular replacement of this rotor, can be simplified in this way.

These additional rotors 21, 23, and 25 of the gas turbine 1 are secured by a detachable tool that is supported in turn on the housing 3 of the gas turbine, as indicated with the dotted line in FIG. 1, before the axial displacement of the rotor 19 that is to be disassembled against the direction of flow.

The tool has a radial flange 101 for attachment to the housing 3 and an axial web 102, as well as fasteners 103, 104-106 for form-fitting and/or friction-locking attachment to the housing 3 and the additional rotors 21, 23, and 25. The fasteners may in particular have one or more recesses and/or protrusions for form-fitting attachment and/or have one or more tension devices, in particular screws, for friction-locking attachment (not shown).

Initial assembly or reassembly of the front rotor 19 in the direction of flow into the housing 3 from the front takes place essentially in the reverse order from the disassembly described above, so that reference is made to this in addition.

Accordingly, first the rotor 19 to be assembled and then the outer sealing ring 27 are displaced axially into the housing 3 in the direction of flow. In doing so, the parts of the outer sealing ring are shifted radially to the housing of the gas turbine and then are joined to the outer sealing ring, in particular being braced and/or connected in a form-fitting manner in the circumferential direction (see FIG. 2C with the opposite direction of the arrow). This radial shift is superimposed on the axial displacement of the entire outer sealing ring or the outer sealing ring parts. In the last step (see FIG. 2B→FIG. 2A) in particular, the complete outer sealing ring is displaced axially in the direction of flow, so that the radial protrusions 3.1 on the housing engage in the axial grooves in the outer sealing ring, thereby securing it and/or attaching it by the C ring in the circumferential direction and in the direction of flow in addition to the friction-locking effect.

After the radial and axial displacing and joining of the outer sealing ring parts, the outer sealing ring 27 is detachably attached to the housing 3 by placing the C ring 45 in position, bracing the outer sealing ring and the housing in a friction-locking manner and displacing the rotor 19 axially against the direction of flow (see FIG. 2B, with the direction of the arrow reversed).

Next the tool 101-106 is released and the connecting flange 9 is detachably connected to the housing 3.

Figure 3:
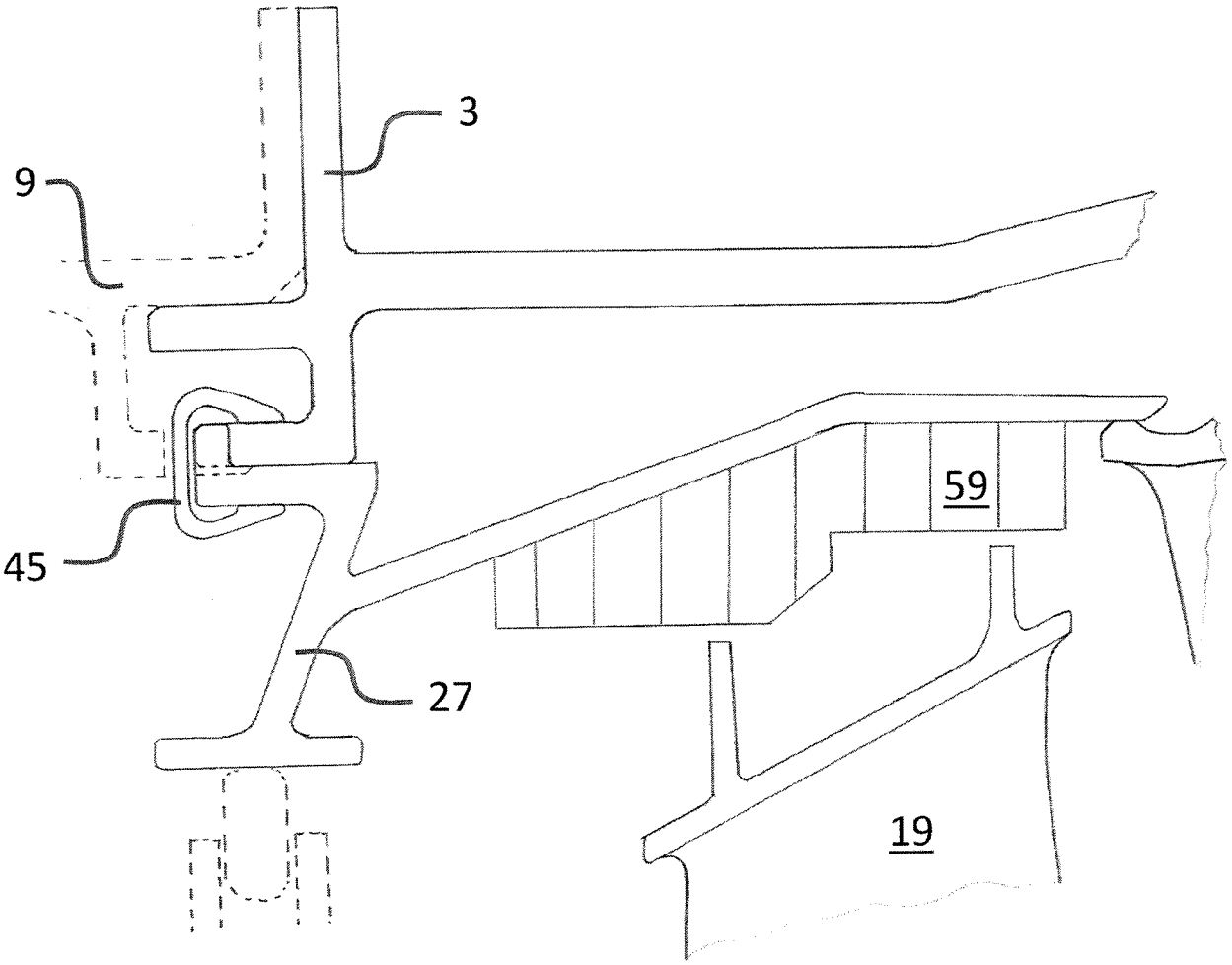
FIG. 3 shows one part of a gas turbine according to another embodiment of the present invention.
Figure 5:
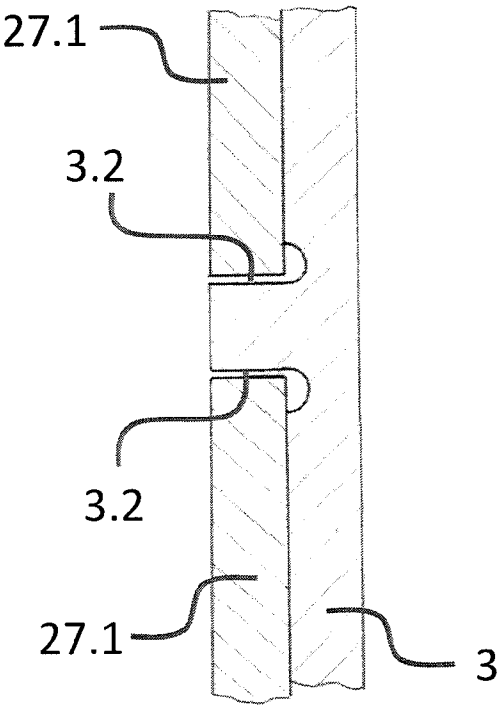
FIG. 5 shows a section along line V-V in FIG. 4.
Figure 4:
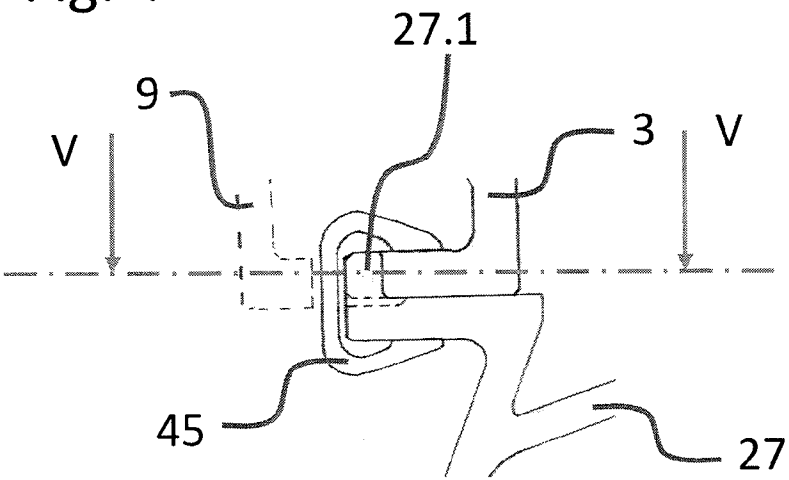
FIG. 4 shows an enlarged detail of the gas turbine from FIG. 3.

FIG. 3 shows, in a diagram corresponding to FIG. 2, a part of a gas turbine according to another embodiment of the present invention. FIG. 4 shows an enlarged detail of a friction contact surface between the outer sealing ring and the housing, and FIG. 5 shows a section along V-V in FIG. 4. Corresponding elements are labeled with identical reference numerals, so that reference may be made to the description above and only differences will be discussed below.

In the embodiment in FIGS. 3-5, the outer sealing ring 27 is also attached to the housing 3 by the C ring 45 in a friction-locking and releasable manner, but without a form-fitting connection. After releasing the C ring, the outer sealing ring can be displaced axially against the direction of flow (toward the left in FIG. 3) without thereby being hindered by a stop on the friction contact surface between the outer sealing ring and the housing.

In contrast with the embodiment of FIG. 2, in the embodiment in FIGS. 3-5, as shown in particular in the sectional view in FIG. 5, the outer circumferential surface of the outer sealing ring 27 has a plurality of radial protrusions 27.1 for friction-locking connection to the inside circumferential surface of the housing 3, which is opposite the former radially, these radial protrusions extending radially outward and engaging in axial grooves 3.2 in an end face of the housing, which is at the front in the direction of flow (at the left in FIGS. 3-5), in order to secure and/or fasten the outer sealing ring in the circumferential direction and in the direction of flow in a form-fitting manner on the housing.

As also discernible in the sectional view in FIG. 5 in particular, the extent of the radial protrusions 27.1 is larger in the circumferential direction than the distance between two neighboring walls in the circumferential direction of axial grooves 3.2, which are neighboring in the circumferential direction. To this extent, the terms "groove" and "protrusion" do not constitute any restriction on generality, because in the case of a plurality of grooves and protrusions distributed in the circumferential direction, one or the other may be regarded as a groove or as a protrusion.

Although exemplary embodiments have been explained in the preceding description, it should be pointed out that a number of modifications are also possible. Furthermore, it should be pointed out that that the exemplary embodiments are merely examples which should not restrict the scope of protection, the applications and the structure in any way. Instead, a guideline for implementation of at least one exemplary embodiment is provided by the preceding description for those skilled in the art, but various modifications in particular with regard to the function and arrangement of the components described here may be made without going beyond the scope of protection, as defined by the claims, and combinations of features that are equivalent to these.

LIST OF REFERENCE NUMERALS

1 low-pressure gas turbine
3 housing
3.1 radial protrusion
3.2 axial groove
5 channel
7 outlet housing
9 connecting flange
11, 13, 15, 17 guide baffle
19 front rotor
19*a* radial flange
21, 23, 25 additional rear rotor
27, 29, 31, 33 outer sealing ring
27.1 radial protrusion
45 C ring (connection)
59 honeycomb seal abradable coating
101 radial flange on the tool
102 axial web on the tool
103-106 fasteners on the tool
$d_5$ minimum inside diameter of channel 5 of the housing 3
$D_{19}$ maximum outside diameter of the front rotor 19
$d_{27}$ minimum inside diameter of the outer sealing ring 27
$D_{27}$ maximum outside diameter of the outer sealing ring 27

As also discussed above, the foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for disassembly of a rotor of a gas turbine, wherein the rotor is disposed within a housing and a channel which diverges in a direction of flow, comprising the steps of:

axially displacing an outer sealing ring that is radially opposite the rotor against the direction of flow, wherein a minimum inside diameter of the outer sealing ring is smaller than a maximum outside diameter of the rotor; and following the step of axially displacing the outer sealing ring, axially displacing the rotor against the direction of flow out of the housing.

2. The method according to claim 1, further comprising the steps of:

dividing the outer sealing ring into parts, wherein a maximum outside diameter of the outer sealing ring is larger than a minimum diameter of the channel; and radially shifting the outer sealing ring parts toward an axis of rotation of the gas turbine.

3. The method according to claim 2, further comprising the step of axially displacing the rotor in the direction of flow before the step of radially shifting the outer sealing ring parts.

4. The method according to claim 1, wherein, before the step of axially displacing the outer sealing ring against the direction of flow, a connecting flange which is connected to the housing and which has an inside diameter facing the rotor that is smaller than a maximum outside diameter of the outer sealing ring, is released from the housing.

5. The method according to claim 1, wherein, before the step of axially displacing the outer sealing ring against the direction of flow, a C-ring connecting the outer sealing ring to the housing is removed.

6. The method according to claim 1, further comprising the step of securing a second rotor of the gas turbine on the housing by a detachable tool.

7. The method according to claim 1, wherein the rotor is a front rotor of the gas turbine.

* * * * *